United States Patent [19]

Makimoto et al.

[11] 4,292,610

[45] Sep. 29, 1981

[54] TEMPERATURE COMPENSATED COAXIAL RESONATOR HAVING INNER, OUTER AND INTERMEDIATE CONDUCTORS

[75] Inventors: Mitsuo Makimoto; Sadahiko Yamashita, both of Kawasaki, Japan

[73] Assignee: Matsushita Electric Industrial Co., Ltd., Osaka, Japan

[21] Appl. No.: 115,396

[22] Filed: Jan. 25, 1980

[30] Foreign Application Priority Data

Jan. 26, 1979 [JP] Japan ..... 54-8352

[51] Int. Cl.[3] ..... H01P 1/30; H01P 7/04

[52] U.S. Cl. ..... 333/222; 333/234; 333/207; 331/107 C

[58] Field of Search ..... 333/222-226, 333/234, 245

[56] References Cited

U.S. PATENT DOCUMENTS 2,103,457 12/1937 Hansell ..... 333/234 X
2,181,901 12/1939 Lindenblad ..... 333/222
3,413,577 11/1968 Massano ..... 333/226

*Primary Examiner*—Paul L. Gensler
*Attorney, Agent, or Firm*—Lowe, King, Price & Becker

[57] ABSTRACT

A coaxial cavity resonator comprising an outer conductor and an inner conductor coaxially disposed in the outer conductor with one end of the inner conductor being connected to an end wall of the outer conductor to establish a short-circuit relationship and the other end of the inner conductor being spaced from the other end wall of the outer conductor to establish an open-circuit relationship. An intermediate hollow conductor is disposed coaxially with the inner and outer conductors and encircles a portion of the axial dimension of the inner conductor. The intermediate conductor has a closed end which is connected with the open-circuit end of the inner conductor.

6 Claims, 13 Drawing Figures

TEMPERATURE COMPENSATED COAXIAL RESONATOR HAVING INNER, OUTER AND INTERMEDIATE CONDUCTORS

BACKGROUND OF THE INVENTION

The present invention relates to a coaxial cavity resonator having a reduced dimension with a high Q value in the ultrahigh frequency band (0.3 to 3 GHz).

Most of the coaxial cavity resonator of the UHF range are of the lumped constant LC type, or of the halfwave or quarter-wave coaxial type. The lumped constant type has an advantage of compactness, but it has a disadvantage of a high loss, while the halfwave or quarter-wave type has an advantage of low loss, but it has a disadvantage of greater dimension than the former. Therefore, the compactness and low loss characteristics of the prior art coaxial cavity resonator are not satisfactory.

Although it is known that the provision of a dielectric material of a high dielectric constant with a low dielectric loss in a space between the inner and outer conductors of the coaxial cavity resonator could result in a resonator having a reduced dimension and an increase in the Q value, the present invention eliminates the use of such dielectric material for the purposes of solving the aforesaid problems.

SUMMARY OF THE INVENTION

Accordingly, an object of the present invention is to provide a coaxial cavity resonator having a reduced axial dimension and a high Q value.

A solution to the aforesaid problem is obtained by the provision of an intermediate hollow conductor having one end closed and connected to the open-circuit end of an inner conductor which is disposed in a coaxial relation within an outer conductor. The intermediate hollow conductor is disposed between the inner and outer conductors and encircles the inner conductor. The intermediate conductor extends axially in parallel relation with the inner and outer conductors over a length smaller than the length of the inner conductor.

Because of the hollow inner structure of the intermediate conductor, the latter defines therein a transmission line with the inner conductor and another transmission line with the inner surface of the outer conductor. These transmission lines, together with a further transmission line which exists between the inner and outer conductors, contribute to the reduction of the overall axial dimension of the coaxial cavity resonator and to the augumentation of the Q value.

Because of the hollow structure of the intermediate conductor, the resonator of the invention also assures a reduction in weight and eliminates the need to provide an extra structure to support the inner structure of the resonator with respect to the outer conductor.

Further, the present invention provides a coaxial cavity resonator which is immune to temperature variations by forming the inner conductor with a metal having a thermal expansion coefficient equal to or smaller than that of the metal constituting the outer conductor and by forming the intermediate hollow conductor with a metal having a thermal expansion coefficient smaller than that of the metal constituting the outer conductor.

BRIEF DESCRIPTION OF THE DRAWINGS

The invention will be further described by way of example with reference to the accompanying drawings, in which.

DETAILED DESCRIPTION

Figure 1:
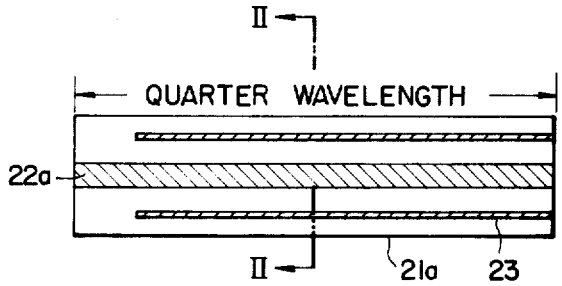
FIG. 1 (PRIOR ART)
FIG. 1 is a longitudinal cross-sectional view of a known uniform transmission line quarter-wave coaxial cavity resonator.
Figure 2:
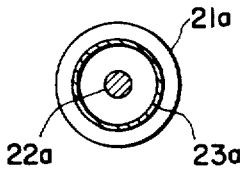
FIG. 2 is a transverse cross-sectional view taken along the lines II of FIG. 1.

Prior to the description of the present invention, reference is first made to the description of prior art coaxial cavity resonators which are illustrated in FIGS. 1 to 6. FIGS. 1 and 2 are illustrations of an exemplary embodiment of a prior art uniform transmission line coaxial cavity resonators which is basically of a half wavelength type with an inner conductor **22*a* being short-circuited at its opposite ends with the opposite end walls of an outer cylindrical conductor 21*a*, the latter constituting with an intermediate hollow conductor 23*a*** a double-layered coaxial cavity resonator. The overall length, or longitudinal axial dimension, of the resonator of this type is slightly less than that of a quarter-wave coaxial cavity resonator.

Figure 3:
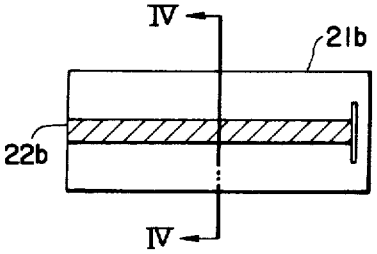
FIG. 3 (PRIOR ART)
FIG. 3 is a longitudinal cross-sectional view of another prior art quarter-wave coaxial cavity resonator.
Figure 4:
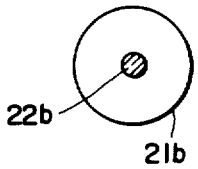
FIG. 4 is a transverse cross-sectional view taken along the lines IV of FIG. 3.

FIGS. 3 and 4 are illustrations of a prior art embodiment of quarter-wave coaxial cavity resonators which comprises an inner conductor **22*b* and an outer conductor 21*b* with the inner conductor 22*b* having its one end being spaced from an inner end wall of the outer conductor 21*b*** to impart a capacitive coupling therewith, a structure known as a semi-coaxial cavity resonator. However, the Q value of the resonator of this type sharply decreases as its longitudinal axial dimension decreases. Another disadvantage is that this prior art resonator must be provided with a high precision type mechanical structure to enable adjustment of the capacitance value at the open-circuit end.

Figure 5:
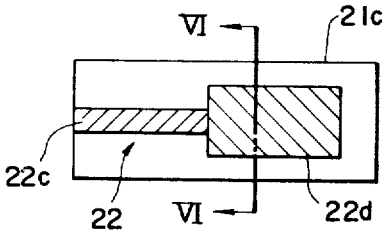
FIG. 5 (PRIOR ART)
FIG. 5 is a longitudinal cross-sectional view of a further prior art coaxial cavity resonator.
Figure 6:
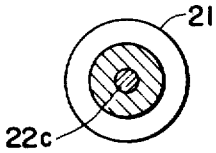
FIG. 6 is a transverse cross-sectional view taken along the lines VI of FIG. 5.

FIGS. 5 and 6 are illustrations of another coaxial cavity resonator which is disclosed in U.S. Pat. No. 4,059,815 granted to M. Makimoto et al. and assigned to the same assignee as the present invention. This resonator comprises an inner conductor 22 which is formed with a small diameter section **22*c*** and a larger diameter section 22*d*, with the smaller diameter section being in a short-circuit connection at one end with an inner end wall of the outer conductor 21*c* and the larger diameter section being in an open-circuit relation with the other end wall of the outer conductor 21*c*. The resonator of FIG. 5 has a high line impedance at the short-circuited end of the inner conductor 22 and a low line impedance at the open-circuit end of the inner conductor. This structure eliminates the disadvantage of the FIG. 2 prior art coaxial cavity resonator.

However, because of the relatively large dimensions of the larger diameter section, the inner conductor 22 must be firmly secured to the outer conductor 21*c* by means of a suitable mechanical structure to prevent vibrations of the larger diameter section with respect to the outer conductor when the resonator is subject to an externally applied impact. Further, the solid interior of the larger diameter section 22*d* of the inner conductor has no electrical properties that contribute to resonance other than coupling it to the smaller diameter section.

The present invention is to provide a coaxial cavity resonator which eliminates the aforesaid various problems and will be described hereinbelow.

Figure 7:
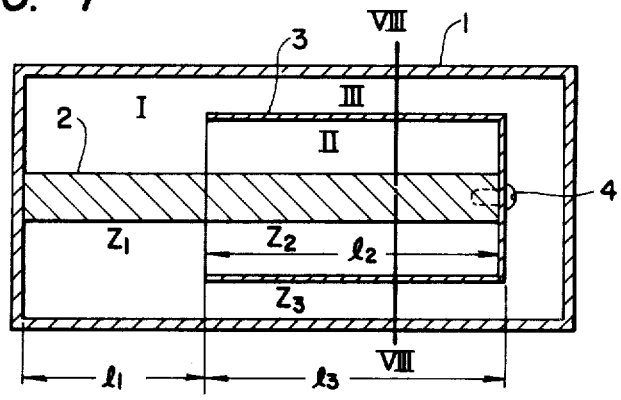
FIG. 7 is a longitudinal cross-sectional view of a quarter-wave coaxial cavity resonator according to the present invention.
Figure 8:
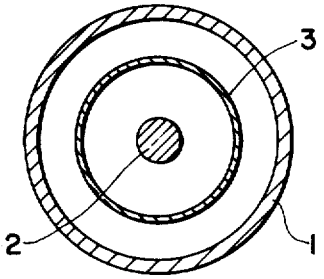
FIG. 8 is a transverse cross-sectional view taken along the lines VIII of FIG. 7.

FIG. 7 is an illustration of an embodiment of the present invention which is basically similar in construction to the embodiment of FIG. 5 with the exception that the open-circuit end of an inner conductor 2 is constituted by a double-layered coaxial configuration. More specifically, the FIG. 7 embodiment is a quarter-wave coaxial cavity resonator which comprises a first hollow conductor, or outer conductor 1 of a cylindrical structure, a second or inner conductor 2 coaxially mounted in and with respect to the outer conductor 1 with one end of the former being connected in a short-circuit relation with one wall of the outer conductor 1 and with the end being spaced from the other end of the outer conductor 1 to provide an open-circuit relation therewith, and a third or intermediate hollow conductor 3 having a closed end. The latter encircles the second conductor 2 in a coaxial relationship therewith and is connected at its closed end to the open-circuit end of the second conductor 2 by means of a screw 4, the third conductor 3 having a longitudinal axial dimension which is smaller than the longitudinal axial dimension of the second conductor 2.

With this arrangement, it is possible to eliminate the disadvantage of the FIG. 5 prior art embodiment by utilizing the hollow interior space of the third conductor 3, while acieving a compact and light weight resonator. In the illustrated embodiment of the invention, the third conductor 3 is not necessarily connected by means of the screw 4; it may be connected by any other means in so far as it assures that the third conductor 3 is firmly secured to the second conductor 2 or it may be integrally formed with the second conductor.

The coaxial cavity resonator of the present invention can be considered to comprise three separate regions, or transmission lines as illustrated. The region I is an area which is defined by a space between the first and second conductors 1 and 2, and in this instance, the second conductor 2 acts as an inner conductor of a coaxial transmission line while the first conductor 1 acts as an outer conductor that coaxial transmission line. The second region II is a space between the second and third conductors 2 and 3 with the former acting as an inner conductor of another coaxial line and the latter acting as an outer conductor of that coaxial line. The third region III, on the other hand, is defined by a space between the third conductor 3 and the first conductor 1, with the third conductor acting as an inner conductor of a coaxial line and the first conductor 1 acting as an outer conductor of that transmission line.

Since the third conductor 3, whose inner cylindrical surface is electrically important, acts as an outer conductor in the region II and as an inner conductor in the region II (in the latter case the outer surface of the third conductor 3 is electrically important), it is necessary that the third conductor 3 have a minimum thickness which should be much greater than the skin depth which is approximately 0.002 millimeters in cases the material is copper and the operating frequency is 1000 MHz. Therefore, the thickness of the conductor 3 should be greater than 0.2 millimeters, a value 100 times greater than the skin depth.

Let it be denoted that the impedances of the separate regions I, II and III as $Z_1$, $Z_2$ and $Z_3$ and their longitudinal axial dimensions as $l_1$, $l_2$ and $l_3$, respectively, the resonator of the present invention must satisfy the following resonance requirement in which the end effect is ignored for purposes of simplicity:

$$K_3 = (\tan \beta l_1 + K_2 \cdot \tan \beta l_3) \tan \beta l_3$$

where, $K_2 = Z_2/Z_1$ ($<1$)

$K_3 = Z_3/Z_1$ ($>1$)

$\beta$ is a phase constant which is given by $2\pi f_0/C$, where $f_0$ is the resonant frequency and C, the velocity of propagation of light.

Advantages of the present invention will now be described hereinbelow.

The overall axial dimension of the coaxial cavity resonator of FIG. 7 in terms of electrical length, which is given by $\beta l_1 + \beta l_2$, is approximately 35° when $K_2 = 0.83$, $K_3 = 0.17$, $\beta l_1 \simeq 20°$, $\beta l_2 \simeq 15°$, with which parameters the above resonance requirement is satisfied. It is known that the uniform transmission line quarter-wave resonator of FIG. 1 generally has an electrical length of 90°, so that the overall length of the resonator of the present invention is reduced to 0.39 (=35/90) times the length of the conventional uniform transmission line quarter-wave resonator.

The degree of degradation of the unloaded Q value as a result of the aforesaid dimensional reduction is found to be negligibly small as compared with the prior art resonator of FIG. 4 because the structure of the FIG. 7 embodiment avoids the concentration of electromagnetic flux lines in a single point.

A practical embodiment of the invention which is manufactured according to the following design parameters, is found to have a Q value of approximately 1200 at the resonant frequency 850 MHz:

$l_1 = 20$ millimeters;

$l_2 = 12$ millimeters;

$l_3 = 15$ millimeters;

$K_2 = 0.69$;

$K_3 = 0.17$; and the inner diameter of the outer conductor 1 is 15 millimeters.

Therefore, the overall axial dimension of the resonator of the invention, which is given by $l_1 + l_3$, is 35 millimeters. The conventional uniform transmission line quarter-wave coaxial resonator is known to have a maximum theoretical unloaded Q value of 1840 at the resonant frequency of 850 MHz for the overall length of 88 millimeters with the inner diameter of the outer conductor being selected to be 15 millimeters. This means that the resonator of the present invention permits only a reduction of 65% in the unloaded Q value in spite of its reduction in axial dimension by approximately 40% as compared with the uniform transmission line quarter-wave resonator. Whereas, the resonator of FIG. 4, whose axial dimension is reduced to a 40% of the axial dimension of the uniform transmission line resonator of FIG. 1, permits only about 40% (=750) improvement in the Q value, which is unfavorably compared with the invention of FIG. 7.

To provide stability against ambient temperature variations it is preferred that the first conductor 1 be formed of a material having a thermal expansion coefficient greater than the material that constitutes the second and third conductors 2 and 3. For example, the first conductor 1 is formed of copper and the second and third conductors are formed of iron with a silver-plated coating. In this case, a stability of +1.9 ppm/C.° was obtained at a frequency of 930 MHz. Temperature immunity can also be ensured by forming the first and second conductors with a same material such as copper and by forming the third conductor with a material, such as iron with a silver-plated coating, having a smaller thermal expansion coefficient than that of the material of the first conductor.

The present invention further allows a design in which the spurious resonant frequency has a frequency value higher than $4f_0$ where $f_0$ is the fundamental resonant frequency. This means that in designing a bandpass filter the spurious frequency components can be effectively suppressed, so that a wider stop band can be obtained than is possible with the conventional filter with the result that the higher harmonics components which might be present in transmitters can be effectively eliminated.

Figure 9:
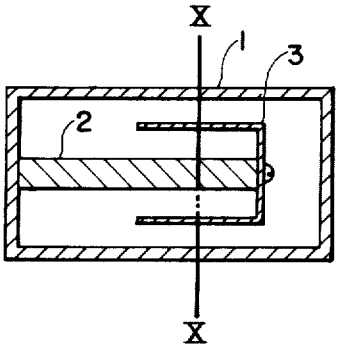
FIG. 9 is an illustration of a modification of the embodiment of FIG. 7.
Figure 10:
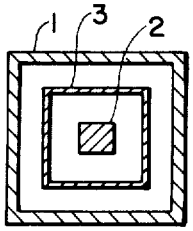
FIG. 10 is a transverse cross-sectional view taken along the lines X of FIG. 9.

Although the foregoing description is concerned with a coaxial cavity resonator having a circular transverse cross-section, the configuration of the transverse cross-section is not limited to circular throughout its axial dimension. FIGS. 9 and 10 are illustrations of another embodiment in which the transverse cross-section is rectangular throughout the length of its transmission line. It is also possible to design a resonator having a circular transverse cross-section along a portion of the transmission line and a rectangular transverse cross-section along the remainder of the line.

Figure 11:
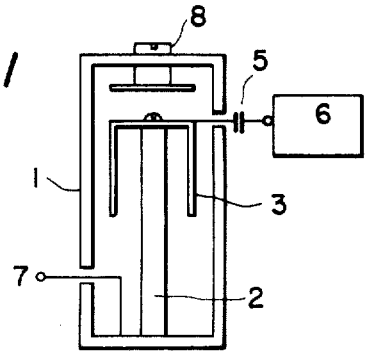
FIG. 11 is an illustration of an oscillator embodying the coaxial cavity resonator of the invention.

FIG. 11 is an illustration of an oscillator incorporating the coaxial cavity resonator of the invention in which the same elements are numbered with the same numerals as used in FIG. 7 and the description thereof is omitted for the sake of simplicity.

Numeral 5 is a coupling condenser which connects the third conductor 3 to an active network 6 such as transistor circuitry and numeral 7 is an output terminal from which microwave energy is withdrawn. A frequency adjustment screw 8 is provided on one end of the outer conductor 1 to allow adjustment of the capacitance value of the open-circuit end of the inner conductor 2. The active network 6 is so designed that it offers a negative resistance as viewed from the oscillator. The output power can also be withdrawn by a capacitive coupling means, unlike the one shown in FIG. 11 in which the output is coupled inductively to the terminal 7. Further, the output power can be taken out from the active network 6.

Figure 12:
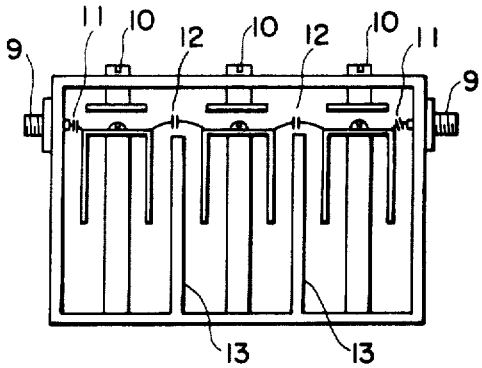
FIG. 12 is an illustration of a bandpass filter embodying the coaxial cavity resonator of the invention.

FIG. 12 is an illustration of a bandpass filter embodying the present invention. The filter comprises three stages of coaxial cavity resonator of identical construction to that shown in FIG. 7 and includes input and output connectors 9, tuning screws 10, input and output coupling condensers 11 and interstage coupling condensers 12. Numeral 13 designates intermediate walls which serve as the outer conductors of the respective coaxial resonators. The axial length of the intermediate walls or partitions is approximately equal to the length of the inner conductors.

Figure 13:
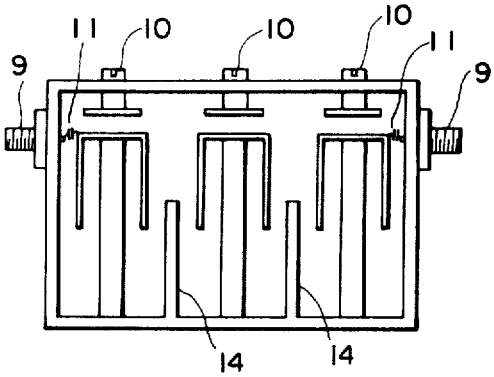
FIG. 13 is an illustration of a modification of the embodiment of FIG. 12.

FIG. 13 is an illustration of a modified form of the embodiment of FIG. 12. In this modification, the interstage coupling is effected by means of distributed reactances, the reference numerals being the same as those used in FIG. 12 except for numeral 14 which designates the intermediate walls having an axial dimension smaller than the walls 13 of FIG. 12 to provide distributed interstage coupling.

In summary, the coaxial cavity resonator of the present invention is of a quarter wave type having an inner conductor with one end thereof being connected in a short-circuit relationship with an end wall of the outer conductor and the other end thereof being spaced from the other end wall of the outer conductor in an open-circuit relationship therewith. The invention is characterized by the provision of a hollow intermediate conductor which encircles the open-circuit end portion of the inner conductor, the hollow intermediate conductor having a closed end connected to the open-circuit end of the inner conductor. The resonator of the invention thus achieves compactness and light-weight construction with a high Q value.

What is claimed is:

1. A temperature compensated, coaxial cavity resonator comprising, a first, outer conductor of a hollow structure, a second, inner conductor internally disposed in a coaxial relationship with said first conductor and in a short-circuit connection at one end thereof with one end wall of said first conductor and in an open-circuit relationship with the other end wall of the first conductor, and a third, inner conductor of a hollow structure coaxially disposed with and encircling said second conductor, said third conductor having a closed end which is connected to the open-circuit end of said second conductor and the axial extent of said third conductor being smaller than the axial extent of said second conductor, said first conductor having a thermal expansion coefficient equal to or greater than the thermal expansion coefficient of said second conductor and greater than the thermal expansion coefficient of said third conductor, longitudinal expansion of said first, second and third conductors as a function of temperature being electrically compensated by transverse expansion as a function of temperature of said first and third conductors, whereby said resonator has a resonant frequency that is substantially independent of temperature.

2. A coaxial cavity resonator as claimed in claim 1, wherein the transverse cross-section of each of said first, second and third conductors is of circular configuration.

3. A coaxial cavity resonator as claimed in claim 1, wherein the transverse cross-section of each of said first, second and third conductors is of rectangular configuration.

4. A coaxial cavity resonator as claimed in any one of the preceding claims, wherein the thickness of said third conductor is much greater than the skin depth of said resonator.

5. A coaxial cavity resonator as claimed in claim 1, wherein said first and second conductors are formed of a metal having a same value of thermal expansion coefficient.

6. A coaxial cavity resonator as claimed in claim 1, wherein said second and third conductors are formed of a metal having a same value of thermal expansion coefficient.

* * * * *